US005100315A

United States Patent [19]

Schodorf et al.

[11] Patent Number: 5,100,315

[45] Date of Patent: Mar. 31, 1992

[54] POCKET WHEEL FURNACE APPARATUS

[75] Inventors: David V. Schodorf, Navarre; Harold F. Amstead, Massilon; Ross E. Ducker, North Canton; Jack O. Fickes, Dover; Gary L. Wells, Pataskala, all of Ohio

[73] Assignee: The Timken Company, Canton, Ohio

[21] Appl. No.: 620,847

[22] Filed: Dec. 3, 1990

[51] Int. Cl.[5] ..... F27B 9/14

[52] U.S. Cl. ..... 432/124; 432/162

[58] Field of Search ..... 432/124, 131, 132, 142, 432/162

[56] References Cited

U.S. PATENT DOCUMENTS

| | | | |
|---|---|---|---|
| 1,382,148 | 6/1921 | Walker . | |
| 3,004,754 | 10/1961 | Walpole et al. | 432/162 |
| 3,732,069 | 5/1973 | Wiser et al. | 432/124 |
| 3,807,583 | 4/1974 | Manger . | |
| 4,050,888 | 9/1977 | Pfister et al. | 432/124 |
| 4,052,152 | 10/1977 | Whelan et al. | 432/124 |
| 4,341,297 | 7/1982 | Turner . | |
| 4,622,006 | 7/1982 | Hohne . | |
| 4,763,880 | 8/1988 | Smith et al. . | |
| 4,834,649 | 5/1989 | Levit | 432/124 |
| 4,906,183 | 3/1990 | Kyffin et al. | 432/124 |

*Primary Examiner*—Henry C. Yuen

*Attorney, Agent, or Firm*—Gravely, Lieder & Woodruff

[57] ABSTRACT

A pocket wheel furnace having a furnace housing provided with a heat source in the side walls to project heat upon the components requiring heat treatment. The components are loaded into the pockets on the wheel at a first station and travel through the projected heat for the time needed to reach the heat treatment temperature before reaching a discharge station where the components are moved to a quench station. The travel time in the furnace is predetermined and is substantially equivalent for all components in a batch thereof.

1 Claim, 6 Drawing Sheets

POCKET WHEEL FURNACE APPARATUS

BACKGROUND OF THE INVENTION

1. Field of the Invention

This invention is directed to pocket wheel furnaces for maintaining the orientation of small components being treated in the pockets of a rotary furnace preparatory to plug quenching.

2. Description of the Prior Art

Existing furnaces used for plug quenching all experience difficulty in discharging or extracting small size product components preparatory to delivery of such product or component to a quench press. Whether the existing furnaces are operated by belt, or rotary tray or by rail, the orientation must be proper to obtain effective and acceptable plug quenching.

Examples of the prior art furnaces are seen in U.S. Pat. No. 3,727,896 of Apr. 17, 1973, or U.S. Pat. No. 4,622,006 of Nov. 11, 1986, or U.S. Pat. No. 4,738,577 of Apr. 19, 1988 wherein no particular attention is given to the position of a product in the furnace so its emergence may be substantially correct or best for the quench treat that may follow.

Mechanisms useful in association with rotary furnaces for heat treatment of products are seen in U.S. Pat. No. 4,622,006 of Nov. 11, 1986, or U.S. Pat. No. 4,763,880 of Apr. 17, 1988.

The foregoing prior art examples do not express concern for handling of workpieces in regard to the expected need for quenching following furnace treatment, nor do such examples make any provisions for treating small parts so that they are properly positioned for quenching.

BRIEF SUMMARY OF THE INVENTION

An important object of the invention is to obtain the discharge of products from a furnace while concurrently maintaining orientation of the product through the simple rotation of a wheel with no additional moving parts within the furnace.

Another object of the invention is obtained by the automatic handling of small size product through a heating and/or hardening furnace while maintaining the orientation of such part for subsequent quenching.

Yet another object of the present invention is to provide a charging and discharging mechanism for a rotary furnace in a vertical position so that the objects to be heat treated are properly positioned and remain in the furnace for a required dwell time and are discharged in a predetermined position for subsequent plug quenching.

BRIEF DESCRIPTION OF THE DRAWINGS

The present invention is shown in the following drawings, wherein.

DETAILED DESCRIPTION OF THE EMBODIMENTS

Figure 2:
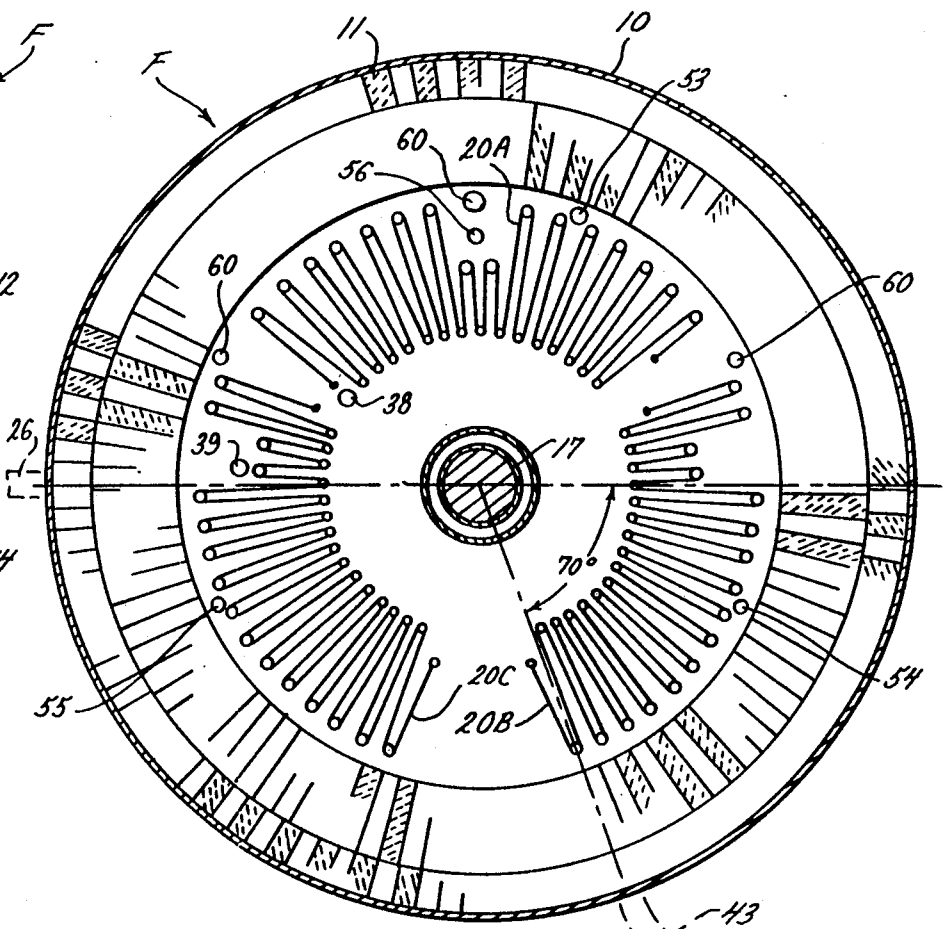
FIGS. 1 and 2 are respectively a cross-section of a heat treating furnace, and a transverse sectional detail taken along the line 2—2 in FIG. 1 to illustrate the arrangement of zone heating elements in one side wall.
Figure 1:
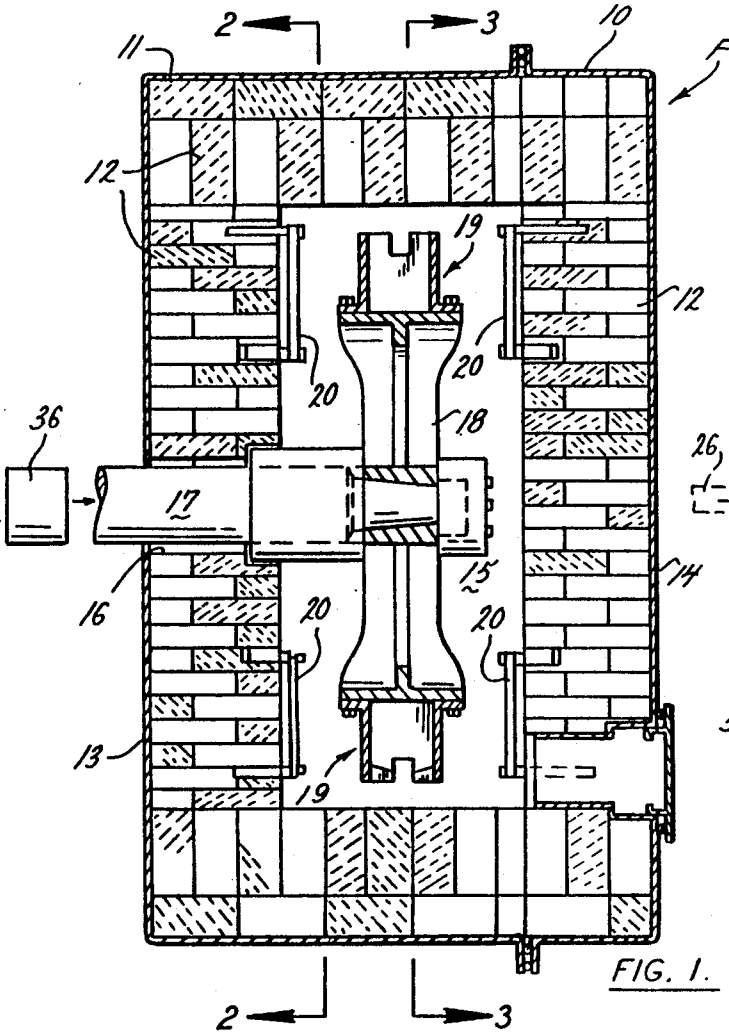

The embodiment of a pocket wheel for a heat treating furnace is seen in FIG. 1 where the furnace F is indicated to have a metallic shell 10 of cylindrical form in section, with an inner insulation layer 11 lying next to the inner surface of the shell 10, and a wall of fire brick blocks 12 located around the interior of the insulation layer 11. The cylindrical shell 10 has opposite closure walls 13 and 14 to retain fire brick blocks in position to enclose the heat treating chamber 15. One end wall 13 is formed with an opening 16 to receive a rotary shaft 17 which supports a wheel 18 within the chamber 15. The periphery of the wheel 18 carries a circumferentially mounted array of pockets 19 which carry the components (not shown) to be heat treated. The source of the heat is an array of ribbon-type electrical heating elements arranged in three zones 20A, 20B and 20C, each suitably supported in the opposite end wall brick work 12 on opposite sides of the circular path of travel of the pockets 19.

Figure 7:
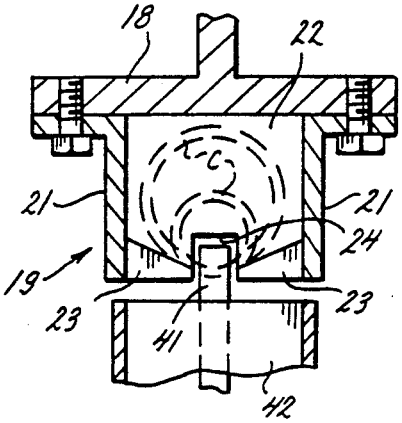
FIG. 7 is a fragmentary view taken along line 7—7 in FIG. 5 illustrating the pocket unloading means for at least two sizes of components.
Figure 8:
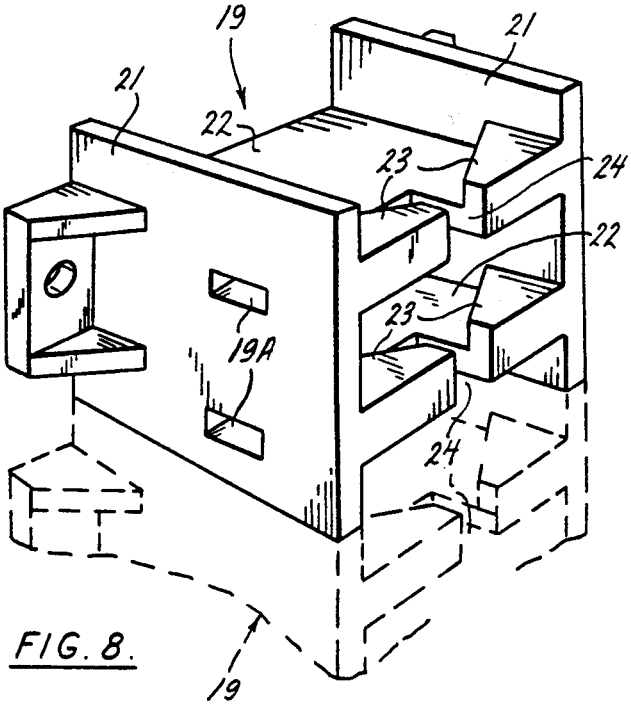
FIG. 8 is a perspective view of a typical pocket for the wheel seen in FIG. 4.

Each pocket 19 (see FIGS. 7 and 8) is constructed of heat resistant metal and is formed with opposite side walls 21 spaced apart by transverse walls 22 for the reception of one or more components C at the loading zone when presented in a normal horizontal loading position at 180° reversed from the position seen in FIG. 8 where the under flat surface of the transverse walls 22 are uppermost. What is seen in FIGS. 7 and 8 is the bottom surface of walls 22 which are formed with raised triangle surfaces or projections 23 which have inner margins that are angled toward the center slots 24 opening through the walls 22 of the pocket for the purpose of centering the component C to be carried in the pockets when resting on a pair of such margins. Each wall as seen in FIG. 7 is formed with a slot 24 oriented to be on the radial center line of the wheel periphery so a stationary finger 41 is able to be located in line with radial center line of the wheel periphery for the purpose of allowing the pocket slots 24 passing the finger 41 which is adapted to lift whichever size of the component C is in the pocket over the projections 23 so the component can slide out of the pocket by gravity. In order to load and unload each pocket so the component is oriented in the desired position for plug quenching, the component C is inserted into the pocket when the flat surface of wall 22 is presented facing up in a horizontal position. The component has a front face that is presented to the flat surface of wall 22. The wheel rotates the component through about 260° from that horizontal position so the component is turned over to rest against the projections 23 with the opposite face down. In this instance the component C is a cup or a cone for a tapered roller bearing. If the component is a cup or a cone then the loading thereof into the pockets must be effected with its front face down so when turned over its back face will be down. Furthermore, each pocket 19 has aligned slots 19A that allow for a light beam to be directed through the pocket 19 to indicate when a pocket is positioned to receive a component.

Figure 3:
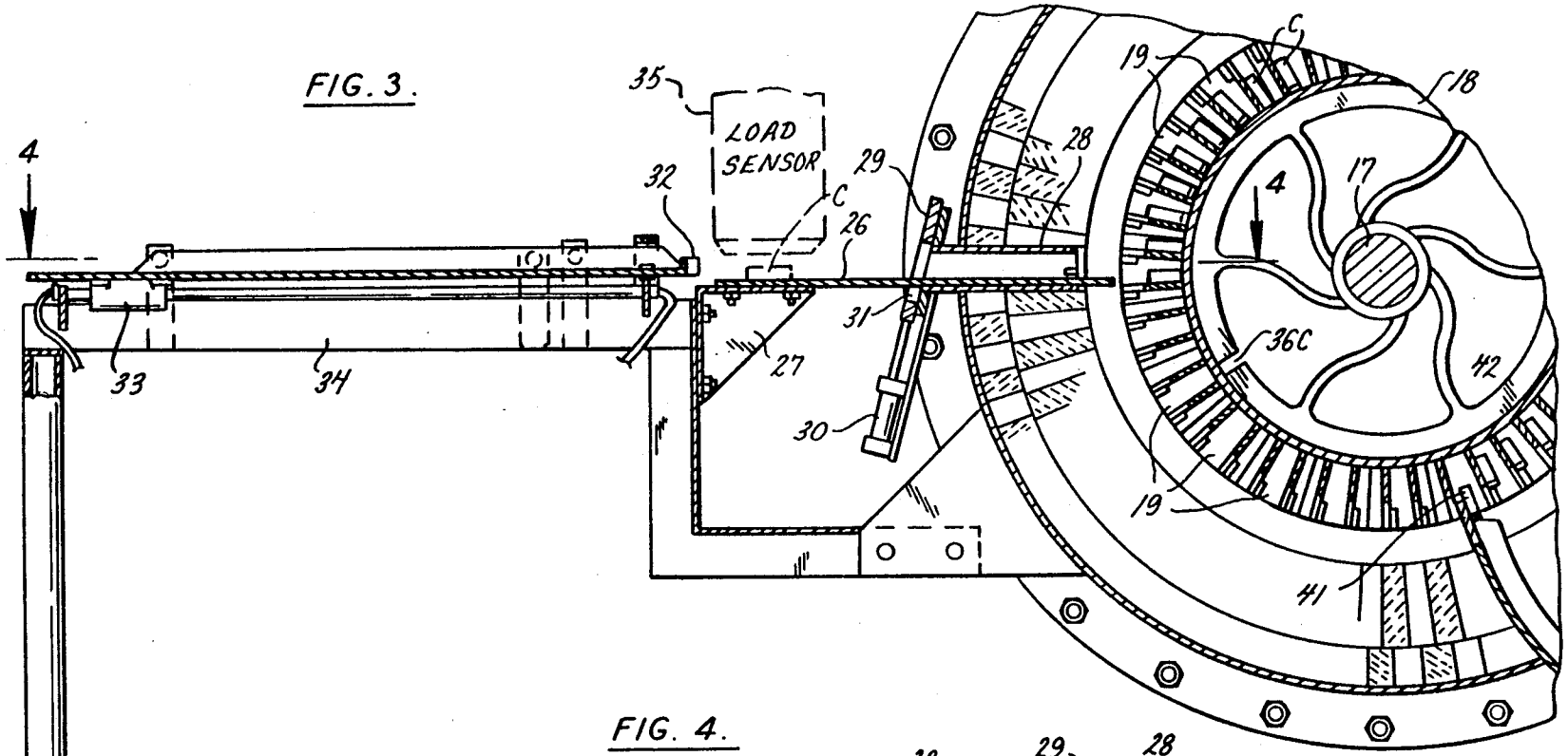
FIG. 3 is a schematic and fragmentary side view of a rotary pocket wheel in a furnace for heat treating components placed in the pockets as the wheel is indexed past a loading station, taken along line 3—3 in FIG. 1.
Figure 4:
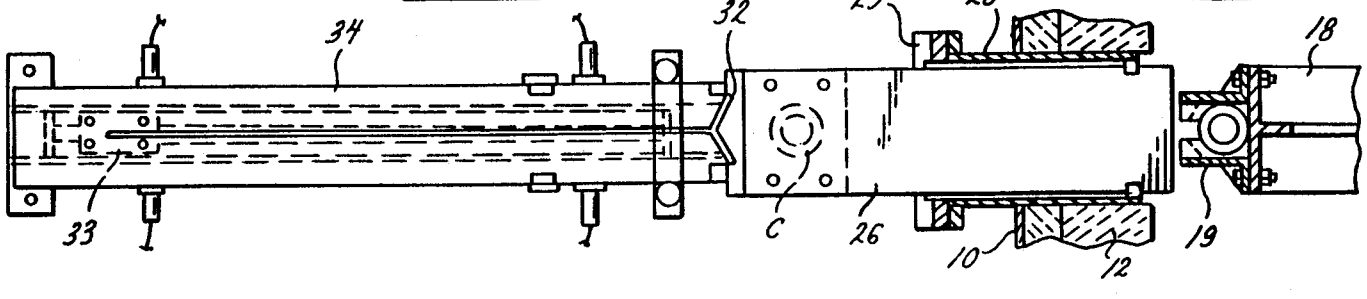
FIG. 4 is a fragmentary plan view of the loading mechanism for a single line of components in a single pocket wheel taken along line 4—4 in FIG. 3.

Turning to FIGS. 3 and 4, the wheel 18 is assumed to have been indexed so each pocket 19 is presented with its flat surface aligned at the level with the slide 26, the slide being on a suitable support 27. The slide 26 extends through a guide chute device 28 which is equipped with a gate 29 operated by means of a power cylinder 30 to raise the gate (as seen in FIG. 3) so its window 31 opens the chute to allow a component to be propelled through the chute device 28 and into the waiting pocket 19. The propelling means 32 has its actuating piston 33 movable through support guide means 34 so its pusher can engage a component when placed on the slide 26. A suitable sensor 35 detects the presence of a component and energizes the piston 33 to propel the component into the pocket 19 and to retract the pusher 32. Thereafter the gate 29 closes the chute until a second pocket on wheel 18 is indexed to its loading position and a component C is detected in loading position on slide 26.

Figure 9:
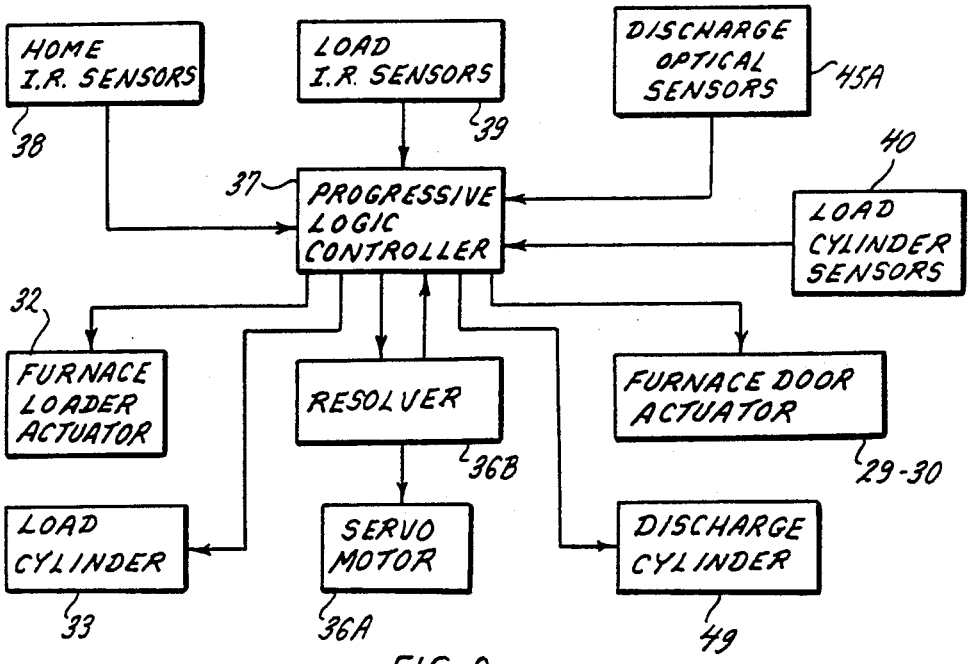
FIG. 9 is a schematic diagram of a control system for the apparatus for heat treating components.

Turning to FIGS. 1 and 9, the drive system for operating the furnace pocket wheel includes a servo motor and resolver assembly indicated at 36 in FIG. 1 and set forth in greater detail in FIG. 9 at 36A and 36B. The combined assembly 36 is operatively related to the shaft 17 which rotates the wheel 18 in the furnace chamber 15. The control system seen in FIG. 9 shows the assembly 36 made up of an individual servo motor 36A and the resolver unit 36B, with the latter unit responsively connected to a programmable logic controller (PLC) 37.

A slot 36C (See FIG. 3) is cut in the inner rib of the wheel, and an infrared sensor 38 is aligned with that slot, and the home position is stored in the memory of the PLC 37 as a "Zero Degrees". The wheel 18 is then rotated until a pocket 19 aligns with the load position of the pusher 32 (see FIG. 3) and an infrared sensor 39 is located to give the resolver 36B the feedback degree position of the pocket to the PLC 37 where it is stored in the memory. The wheel 18 is continued to be rotated until all of the home positions of the pockets 19 have been stored in the PLC memory. Once the wheel 18 has been calibrated to stop at each load position detected by the infrared sensor 39, the PLC 37 is able to actuate the gate power cylinder 30 to open the gate 29 and to actuate the pusher 32 and its cylinder 33, provided the sensor 35 has detected the presence of a component on the slide 26. It is therefor understood that once the wheel 18 has been calibrated to rotate to a position for a pocket 19 the wheel stops, the furnace gate 29 opens and the pusher 32 loads the component on the slide 26 into the pocket. The wheel is then indexed by the PLC 37 to the next pocket. The speed at which the wheel moves between pockets depends on the desired heat treat for the component loaded into a pocket. Thus the dwell time is introduced to the PLC.

The indexing of the wheel 18 to bring each pocket into loading position opposite the guiding chute 28 continues as long as the supply of components is present. The residence or dwell time of each component in the heating chamber 15 (FIG. 1) is controlled by the rotating speed of wheel 18 and the level of the temperature in the furnace chamber 15. For hardening purposes the temperature in chamber needs to be at about 1600° F. for imparting that level of heat in each component by the time the wheel 18 is indexed around about 260° where the components begin to be discharged.

Figures 5, 6:
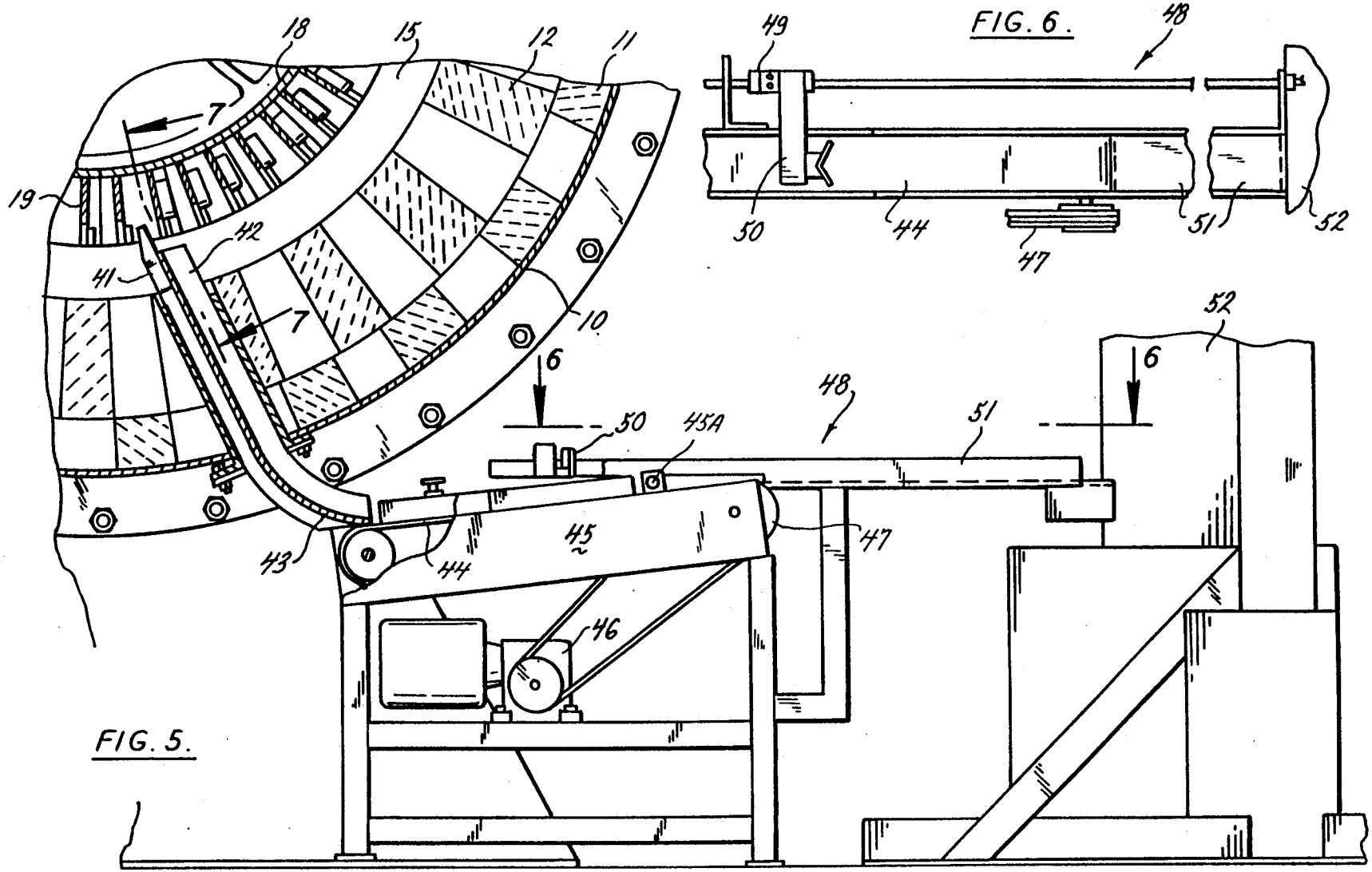
FIG. 5 is a schematic and fragmentary view of means for effecting discharge of components which have attained the desired temperature, the view being a continuation of FIG. 3 to show the discharge of components.
FIG. 6 is a fragmentary plan view of the transfer ram for moving heat treated components to a quench press, the viewing taken along line 6—6 in FIG. 5.

The discharge of components, upon completing the dwell time in the furnace F, are rotated to the position about 260°, more or less, where the pockets 19 have been rotated into the position (see FIGS. 7 and 8) where the walls 22 are presented with the retainer elements 23 uppermost, and the components are resting against the slanted surfaces of those elements and centered to a slot 24. As the wheel approaches the descending position of 260° from the loading position, there is a stationary finger 41 which is aligned with the slot 24 to lift the component above the elements 23 so they are able to discharge by gravity onto a chute 42 (see FIGS. 5 and 7) which directs the component into a position at the bottom 43 of the chute 42. The momentum of the component will project it onto the receiving surface 44 of the belt conveyor assembly 45. A motor 46 drives the power pulley 47 for the conveyor belt 44. A suitable sensor 45A detects the component and energizes a transfer mechanism 48 which includes a cylinder 49 (FIG. 6) with a pusher arm 50 which picks up a component from the top of the belt 44 and slides it on the surface 51 into a quench press 52. Since the wheel 18 is rotating in an indexed sequence, the components will be discharged only when a pocket 19 is moved past the stationary finger 41. It is contemplated that the components will be discharged in timed sequence that will not clog up the discharge assembly 45 and the transfer mechanism in response to the sensor 45A.

Since the function of the furnace F is to obtain a derived heat treatment of components C which may be bearing components, it is important to provide both a temperature control system and an atmosphere control system. These systems are depicted in a schematic way in FIGS. 10 and 11.

Figure 10:
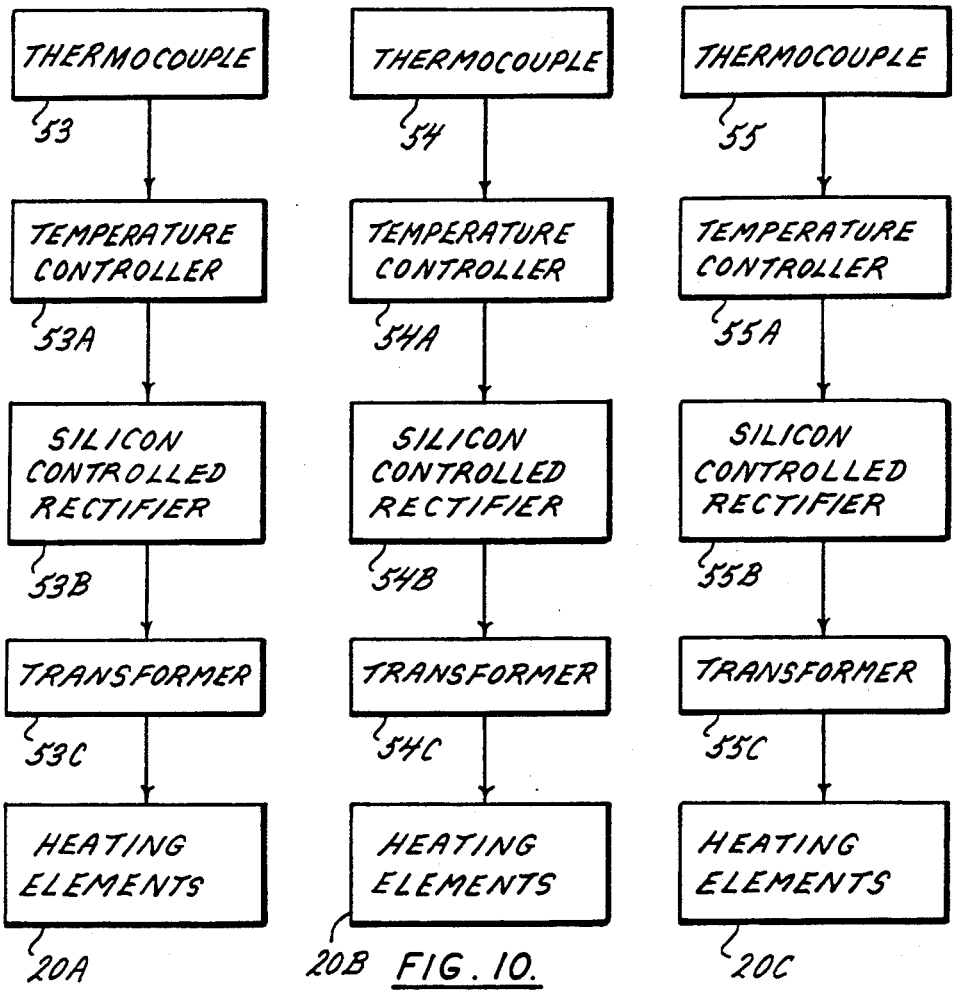
FIG. 10 is a schematic diagram of the zone temperature control system employed in the heat treating furnace of this invention.

FIG. 10 illustrates temperature responsive thermocouples 53, 54 and 55 associated respectively with heat zones 20A, 20B and 20C. The thermocouples feed back to their respective temperature controllers 53A, 54A and 55A. If there is a deviation from the desired temperature, these controllers adjust the amount of power going to the ribbons heating means in zones 20A, 20B or 20C by sending a signal to the silicon controlled rectifiers (SCR) 53B, 54B and 55B which act as switches for the power going through the transformers 53C, 54C and 55C which respectively adjusts the power at the heating elements in zones 20A, 20B and 20C. It is understood that the thermocouples may not all respond in unison, but the system is intended to respond to maintain a desired temperature in the respective zones.

Figure 11:
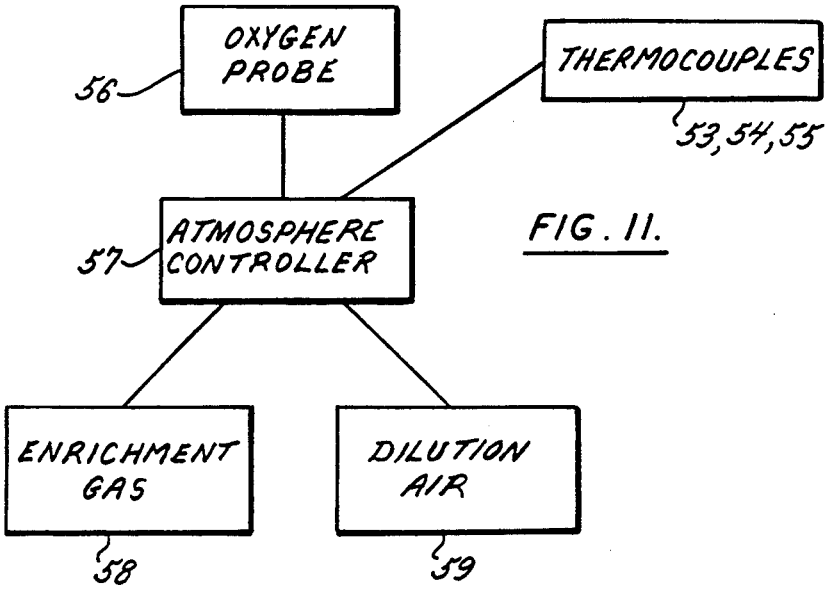
FIG. 11 is a schematic diagram of a furnace atmosphere control system useful herein.

The system depicted in FIG. 11 is intended to regulate the atmosphere in the furnace F. This is essential for the heat treatment of the components C. The pocket wheel 18 rotates in an endothermic atmosphere which is controlled to a desired carbon potential so that neither decarburization or carburization will occur during the heat treatment. An oxygen probe 56 is used to monitor the oxygen content and the temperature which is then converted to carbon potential in the atmosphere controller 57. The atmosphere controller 57 makes adjustments to the atmosphere by adding either enrichment gas from source 58 or dilution air from source 59 to the furnace through inlet ports 60.

Figure 12:
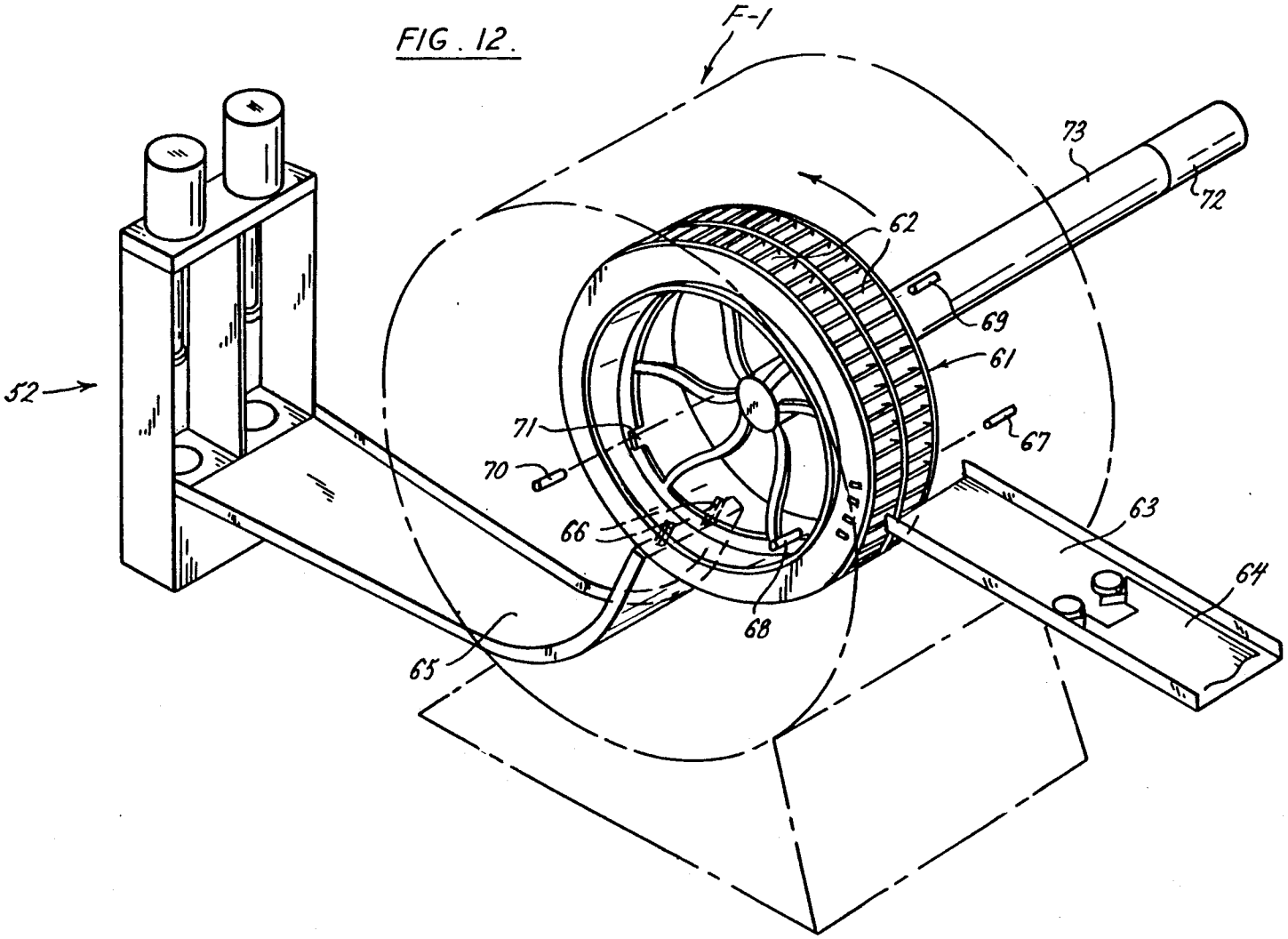
FIG. 12 is a schematic perspective view of the system for rotating a double row pocket which is a heat treating furnace with means to load and discharge components at least two at a time.

Turning to FIG. 12, there is illustrated schematically a modified apparatus for heat treating a pair of components at the same time. While the furnace F-1 is indicated in phantom outline, the rotary wheel 61 is provided with a series of double pockets 62 on the periphery of the wheel 61. As shown, a pair of components located on the slide 63 are propelled by pusher means 64 into a pair of pockets that have been indexed, in the manner before explained, into a position to receive the components. After a pair of components have been moved by rotation of the wheel 61, they reach the location where a dual discharge chute 65 has its fingers 66 in position to lift the components off the centering lip elements so gravity can effect the discharge. The pair of components are directed into the plug quench press 52. The FIG. 12 apparatus is shown in schematic form with the understanding that the structural and operating means of the character previously described in the preceding views for processing a single line of components will be repeated in a suitable modification for handling more than one component at a time. For example, in order to shorten the text, the loading means of FIG. 4 enlarged for loading two components at one time can be employed for the pusher means 64. The discharge means shown in FIGS. 5 and 6 when enlarged to handle two components at the same time can be employed for the discharge chute 65. The control system for FIGS. 10 and 11 include infrared sensors 67 and 68 at the loading position, infrared sensors 69 and 70 with a wheel home position slot 71, and a servo motor and resolver means 72 on the shaft 73 for the wheel 61.

It is contemplated that changes and modification may be made within the scope of the invention as set forth herein.

What is claimed is:

1. An apparatus for heat treating components moving between a starting heat treating position and a discharge heat treating completion position, the apparatus comprising:

(a) a heat treating chamber having heating elements therein;

(b) a component carrying wheel in said chamber rotatable about a horizontal axis and being formed with pockets arranged around the wheel periphery, each of said pockets having a component receiving surface and an opposite component supportive face spaced from said receiving surface, said surfaces and faces being radially directed to define component receiving openings radially directed outwardly from the periphery of said wheel;

(c) means forming a component loading opening in said chamber at the heat treating starting position;

(d) means forming a component discharge opening in said chamber angularly displaced from said first means at the position of the completion of the component heat treatment;

(e) first means adjacent said chamber component loading opening for feeding the components into said radially directed open pockets on said receiving surface in said carrying wheel while in a first position of orientation;

(f) second means adjacent said chamber component discharge opening for receiving components at the completion of the heat treatment thereof while in a position of orientation supported on said opposite face to be reversed from said first position of orientation; and (g) a control system associated with the rotatable component carrying wheel for indexing the pockets one at a time through said first means and regulating the time of components travel from said first means to said second means.

* * * * *